United States Patent [19]

Christensen et al.

[11] 4,168,452

[45] Sep. 18, 1979

[54] TETRODE SECTION FOR A UNITIZED, THREE-BEAM ELECTRON GUN HAVING AN EXTENDED FIELD MAIN FOCUS LENS

[75] Inventors: John A. Christensen, Niles; Peter E. Loeffler; James W. Schwartz, both of Deerfield, all of Ill.

[73] Assignee: Zenith Radio Corporation, Glenview, Ill.

[21] Appl. No.: 861,800

[22] Filed: Dec. 15, 1977

Related U.S. Application Data

[63] Continuation of Ser. No. 694,614, Jun. 10, 1976, abandoned.

[51] Int. Cl.[2] ..... H01J 29/46; H01J 29/56

[52] U.S. Cl. ..... 315/16; 313/449

[58] Field of Search ..... 315/13 R, 13 CG, 16; 313/414, 447, 448, 449, 460

[56] References Cited

U.S. PATENT DOCUMENTS

| | | | |
|---|---|---|---|
| 3,008,064 | 11/1961 | Niklas et al. | 313/82 |
| 3,558,954 | 1/1971 | Lilley | 313/414 |
| 3,995,194 | 11/1976 | Blacker, Jr. et al. | 315/16 |

*Primary Examiner*—Theodore M. Blum

*Attorney, Agent, or Firm*—Ralph E. Clarke, Jr.

[57] ABSTRACT

This disclosure depicts an electron gun especially for use in a color cathode ray tube of the small-neck, shadow-mask type. The gun design is also applicable to other television cathode ray tube displays that require a gun that provides small, symmetrical spots of uniform cross-section, such as guns used in monochrome television and beam index tubes. The gun is comprised essentially of a four-element tetrode section and a main focus lens section. The tetrode section generates at least one electron beam and a cross-over that is imaged on the screen of the tube focused by the main focus lens. The tetrode section is characterized by having a strong prefocus; that is, a prefocus in which the electron trajectories are substantially refracted, or bent, before exiting the tetrode section. The tetrode section has two associated grid means whose dimensions, configurations, and relative spacings, in combination with a strong electrostatic prefocusing field produced between said grids, forms in the grid interspace an electrostatic field which includes in the region of the beam strongly bent, preferably substantially hyperboloidal equipotential lines which help to suppress spherical aberration commonly associated with a highly refractive tetrode section design.

4 Claims, 4 Drawing Figures

TETRODE SECTION FOR A UNITIZED, THREE-BEAM ELECTRON GUN HAVING AN EXTENDED FIELD MAIN FOCUS LENS

CROSS-REFERENCES TO RELATED APPLICATIONS

This application is a continuation of application Ser. No. 694,614 filed June 10, 1976 assigned to the assignee of this application, now abandoned. This application is related to but in no way dependent upon copending applications of common ownership herewith, including Ser. No. 649,630, filed Jan. 16, 1976; and Ser. No. 834,029, filed Sept. 16, 1977.

BACKGROUND OF THE INVENTION

This invention relates generally to an improved electron gun for television receiver cathode ray tubes, and is specifically addressed to an improved tetrode section, or "lower end" of such guns. This invention has applicability to guns of many types and constructions, but is believed to be most advantageously applicable to three-beam unitized electron guns for color television cathode ray tubes.

Unitized electron guns for color cathode ray tubes generate three electron beams developed by cathodic thermionic emission. The resulting beams are formed and shaped by a tandem succession of electrodes spaced along the central axis of the gun. The electrodes cause the beam to be focused on multiple phosphor groups located on the faceplate of the color cathode ray tube.

A prime objective in the design and manufacture of such electron guns is to provide small, symmetrical beam spots on the tube screen to achieve maximum picture resolution. Other desirable characteristics are an ample depth of focus and negligible tendency to arc. In addition, the aberrations that reduce definition which result from third order imagery—spherical aberration, astigmatism, and coma—should be minimal. The latter two of these aberrations are associated with positional distortion, which results when the image point, or object resolved on the screen, is off-axis, usually by reason of a physical misalignment of the gun components.

Electron guns in common use for television color cathode ray tubes consist of two discrete sections. The first is the tetrode section made up of four parts, commonly comprising (in standard terminology) the cathode, the control grid (G1), the accelerator anode (G2), and a section of the first anode (G3) of a main focus lens.

The second section of an electron gun is commonly a main focus lens, usually comprised of two or more electrodes between which are formed the electrostatic fields which serve to focus the beam and to increase the beam voltage. Each of these two sections of the electron gun, and the synergistic relationship each with the other, has been the subject of intensive study for a great many years. The bipotential and unipotential lens configurations described by Maloff and Epstein in 1938 in their text *Electron Optics in Television* (Mc-Graw-Hill) are still in use today. Yet advances in gun design are still being made, as shown by the extended field focus lens described and claimed in U.S. Pat. No. 3,895,253, issued to the assignee of this application.

Much attention has been addressed to the tetrode section of the gun as well as to the focus lens. The prior art shows many examples of attempts to achieve such major objectives as the developing of small, symmetrical spots to provide maximum resolution. Many attempts to improve tetrode section performance include the use of what are called "intrusion-type" electrodes; that is, one or two of the electrodes of the tetrode section have projecting from them a frusto-conical structure facing in the direction of the cathode. In *Electron Optics in Television,* Maloff and Epstein shown an intrusion cone-type structure on the accelerating anode (page 122). This conical structure is attached to a long cylinder for the simple purpose of diverting a beam. No prefocusing is apparently accomplished with this structure, and in general, it must be considered to be only a very early step toward the achievement of an optimized tetrode.

Other examples are found in U.S. Pat. Nos. 2,919,380; 2,484,721; 3,740,607; 3,628,077; and 3,213,311. As will become evident from the following, none of these patents teach the unique tetrode section of this invention.

An example of a tetrode section used in a unitized, in-line gun is shown by Hughes in U.S. Pat. No. 3,873,879. The unitized control grid (G1) and the screen grid (G2) consists of two closely spaced flat plates. The focus lens is the bipotential type; that is, it is a lens which presents to electrons traveling down the lens axes from the source toward the screen target, an axial potential distribution which increases monotonically from an initial low potential near the source to a final high potential. The triode section of this particular gun is characterized by having a weak prefocus; that is, a mild refraction of the beam prior to its entrance into the field of the main focus lens, and a relatively large beam half-angle, unlike the tetrode that is the subject of this disclosure.

U.S. Pat. No. 3,995,194, issued to Blacker and Schwartz and of common ownership herewith, discloses a tetrode section in an in-line gun that utilizes an extended field main focus lens. The tetrode structure is shown schematically in FIG. 1. The tetrode section is distinguished by its deliberate provision of a high penetration factor to the cathode; that is, a large measure of the field of the main focus lens is caused to penetrate the cathode G1–G2 area to affect its operation. Also, the tetrode provides little or no prefocusing. The cited patent is considered to be of interest only in that structurally it bears a superficial resemblance to the novel tetrode section described in the present disclosure.

To summarize an ideal tetrode section would provide: (1) for maximum resolution, a small, symmetrical cross-over for imaging on the screen of a color television cathode ray tube; (2) a cross-over that lies in exact coincidence with the gun axis; (3) a low G3 penetration factor to the cathode; (4) an ample depth of focus; (5) a reduced tendency to arc; (6) physical compatibility with color cathode ray tubes of the small-neck, shadow-mask type; and (7) electrical compatibility with television set circuitry. In turn, an ideal focus lens section would greatly increase beam voltage with only minimal spot size amplification, and would introduce no aberration.

Necessarily, such ideals cannot be fully attained as some of these benefits are in a measure incompatible. To cite an example: physical compatibility with a small neck requires a small gun diameter which leads to a large spherical aberration, which in turn induces a large spot size with reduced resolution. So tradeoffs and compromises must be made. Necessarily, too, the cross-over that is imaged on the screen, no matter how perfectly formed by the tetrode, can be degraded by a focus lens that introduces aberration. For example, as a class, the commonly used bipotential lens suffers from having undesirably poor spherical aberration characteristics and cannot, in a reasonably small space such as is available in a cathode ray tube neck, provide focus beam spots sufficiently small to prevent significant loss in picture resolution, prticularly at high beam current levels.

OBJECTS OF THE INVENTION

It is a general object of this invention to provide an electron gun for television cathode ray tubes that is characterized by improved resolution, especially in highlight areas.

It is a less general object to provide a design for the tetrode section of such a gun that has a cross-over that is small, symmetrical, and of uniform cross-section.

It is another object of this invention to provide a tetrode design capable of strong prefocusing and yet able to help suppress aberration resulting from such prefocusing.

It is yet another object of this invention to provide a gun that is not prone to destructive inter-electrode arcing.

It is another specific object to provide such a gun that can be readily unitized and that lends itself to mass-manufacture.

BRIEF DESCRIPTION OF THE DRAWINGS

The features of the present invention which are believed to be novel are set forth with particularity in the appended claims. The invention, together with objects and advantages thereof, may best be understood, however, by reference to the following description taken in conjunction with the accompanying drawings, in which the several figures of which like reference numerals identify like elements and in which:

DESCRIPTION OF THE PREFERRED EMBODIMENT

This invention is addressed to an improved tetrode or "lower end" section for a unitized electron gun having an extended field lens.

Primarily for cost reasons, the current trend in color television receiver design is toward color tubes with in-line guns and stripe screens. Such tubes permit substantial simplification of convergence-related tube hardware and receiver circuitry. Gun unitization; i.e., the use of common structures for different gun parts, permits further economies.

Figure 2:
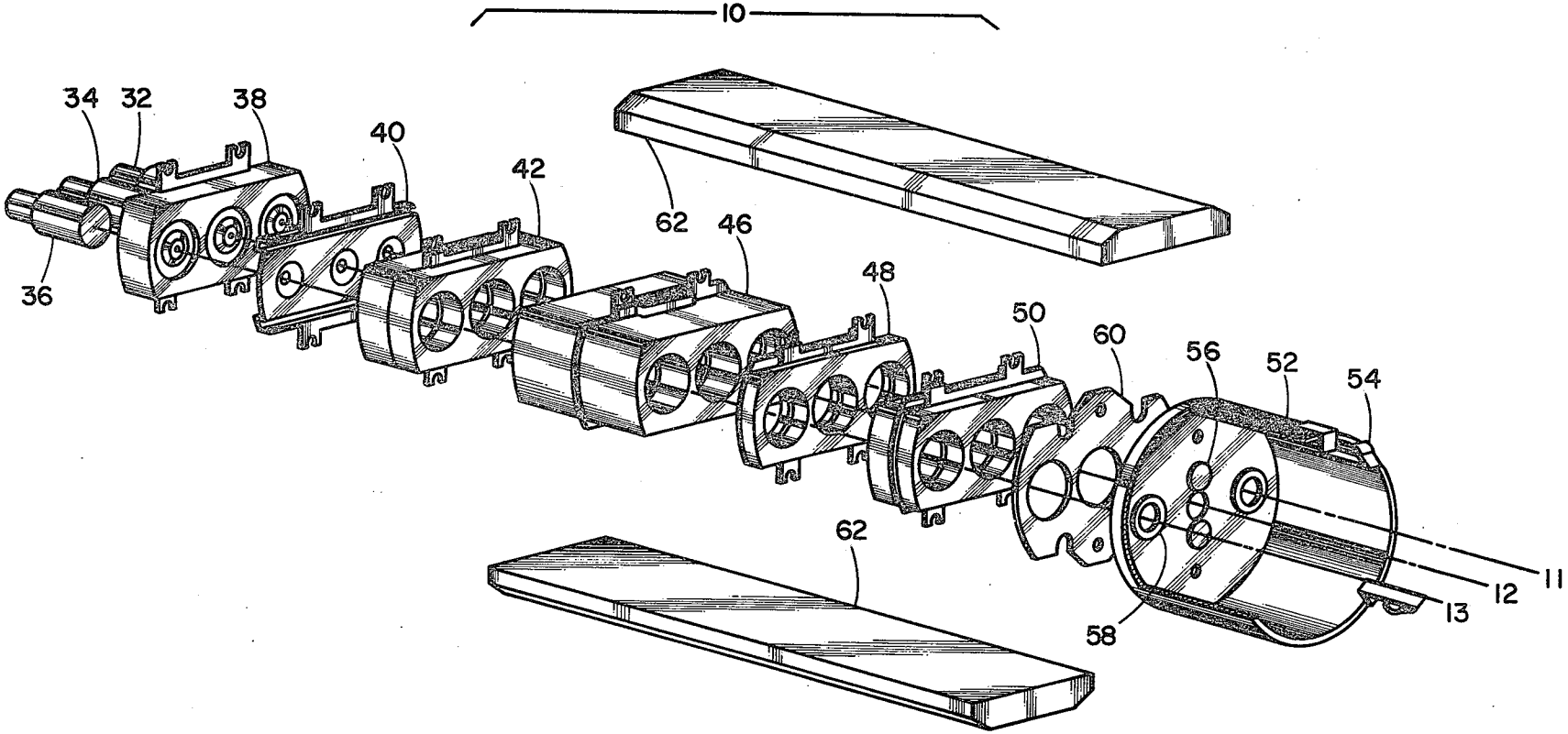
FIG. 2 is an exploded view in perspective of the components of a color cathode ray tube unitized, in-line gun having a tetrode section designed and constructed in accordance with this invention.
Figure 3:
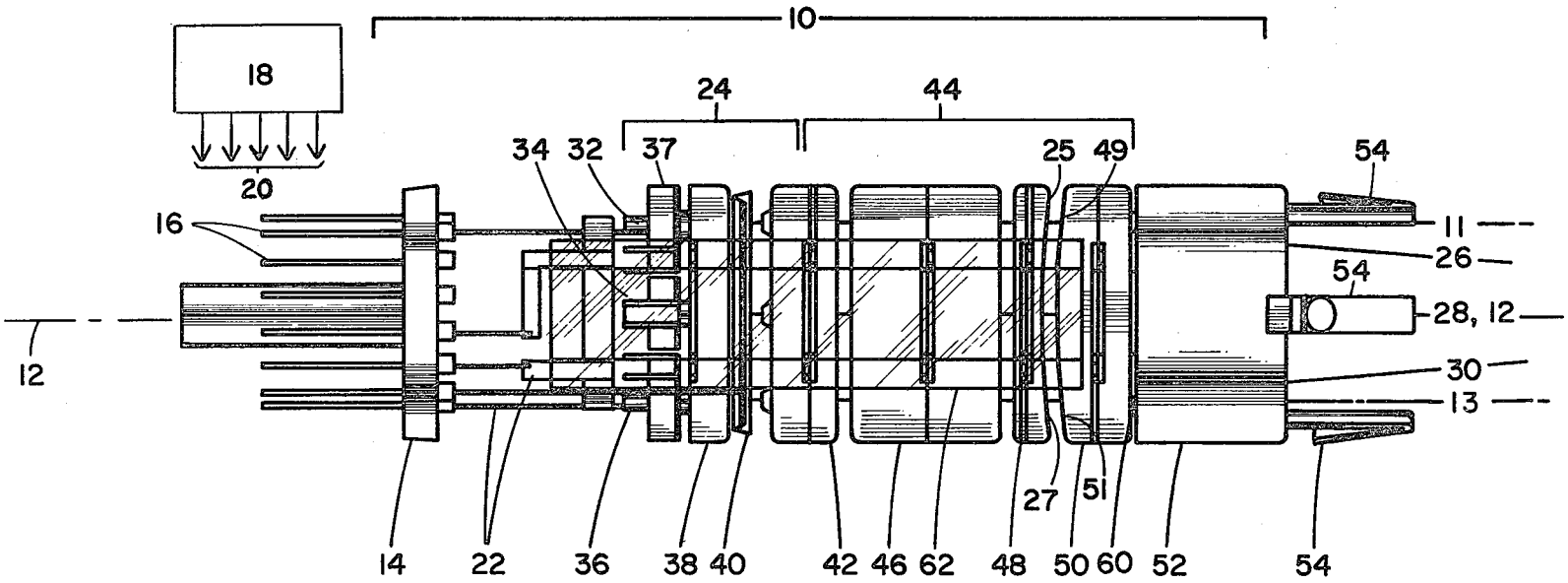
FIG. 3 is an assembled top view of the gun shown in FIG. 2.

Whereas the invention can be embodied in electrode structures of several different types, preferred embodiments of the principles of this invention are illustrated in FIGS. 2–14. FIG. 2 is an exploded view in perspective and FIG. 3 is an assembled view of a unitized, in-line type of electron gun for use in a color television cathode ray tube, which gun incorporates the present invention. The unitized, in-line gun is especially suited to use in a small-neck, shadow-mask type cathode ray tube.

As is well known in the art, the electron gun structure for a cathode ray tube is located at the base of the tube in the narrow neck region opposite the faceplate. The illustrated embodiment is a unitized in-line type gun that generates three coplanar electron beams, each of which is formed, shaped and directed to selectively energize phosphor elements located on the imaging screen in the expanded area at the opposite end of the cathode ray tube envelope (not shown).

Referring to FIGS. 2–5, the gun 10 is illustrated as having a central axis 12. A cathode ray tube base 14 provides a plurality of lead-in pins 16 for introducing into the glass envelope the video signals, as well as certain voltages for beam forming and focusing. A power supply 18, illustrated schematically, develops a predetermined pattern of relatively low, relatively intermediate, and relatively high supply voltages for application to a grid of tetrode section 24 and to the main focus lens section 44 of the gun 10, as will be described. Power from power supply 18 is provided to electron gun 10 through a plurality of external electrical leads 20 routed through the lead-in pins 16 of base 14. The operating signals and voltages are conveyed to the several electrodes of gun 10 within the glass envelope by means of several internal electrical leads; typical leads are shown by 22.

The gun 10 has a tetrode section 24 which generates three separate beam cross-overs (not shown), one for each of the three coplanar beams 26, 28 and 30 (red-associated, green-associated and blue-associated) that lie mainly on three axes 11, 12 and 13. The four elements of the tetrode section 24 are: (1) three discrete cathodes 32, 34 and 36, one for each beam and supported by common cathode support 37; (2) a unitized, three-apertured first grid (or "G1") 38 to partially enclose cathodes 32, 34 and 36; (3) a unitized three-apertured disc-type second grip ("G2") 40; and (4) a unitized three-apertured grid ("G3") 42. Each of three apertures is in axial alignment with one of the three beams 26, 28 and 30. This tetrode section is constructed according to the present invention, and the design will be described in detail after this general description of the entire gun is completed.

The three beam cross-overs are imaged on the screen of the cathode ray tube by main focus lens 44. In the illustrated embodiment, the main focus lens electrodes for the three beams 26, 28 and 30 are unitized and constituted by the "upper end" section, or end facing toward the tube screen, of common main focus electrode 42, and common main focus electrodes 46, 48 and 50. Each of these electrodes is electrically isolated from the others and receives a predetermined voltage from the power supply 18 to form a single extended main focusing electrostatic field. The function and operation of the main focus lens 44, and its relation to the tetrode section 24, is the subject of a more detailed discussion in following paragraphs. To differentiate between the elements of the tetrode section 24 and the main focus lens section 44 in this specification, the anodes of the tetrode section 24 are termed "grids," while the anodes of the main focus lens 44 are termed "electrodes."

Further shaping, directing and focusing of electron beams is accomplished between electrodes 48 and 50, the configuration of which constitutes two separate electron lens components to effect convergence of the outer two beams 26 and 30 inwardly from their respective axes 11 and 13 to a common point of landing with central beam 28, which does not vary from a direct axial path 12. The convergence of outer beams 26 and 30 towards center beam 28 is accomplished in the illustrated embodiment by a slight angling of the two plano-parallel electrode faces 25 and 27 of the two outer beam apertures for beam 26 and 30 of electrode 48, and a parallel, matching angling of the opposed faces 49 and 51 of electrode 50. The angles extend outwardly and forwardly relative to the gun's central axis 12, as shown by FIG. 3. This convergence electrode concept does not constitute per se an aspect of this invention, but is described and claimed in U.S. Pat. No. 4,058,753 assigned to the assignee of this invention.

The last in the series of elements that comprise gun 10 is a support cup 52 that provides a mounting base for the three contact springs 54 which center the forward end of the gun in the neck of the cathode ray tube. Also, through contact with an electrically conductive coating on the inside of the neck of the tube, (now shown), contact springs 54 conduct high voltage through support cup 52 to electrode 50. Located within the cavity formed by the support cup, and adjacent to the apertures from which the three electron beams 26, 28 and 30 emerge, are enhancer magnets 56 and shunt magnets 58. Support cup 52 is aligned and bonded to electrode 50 in precise registration by means of a carrier plate 60, which lies between the two elements.

In the unitized, in-line gun described in this disclosure, unitized grids and electrodes 38, 40, 42, 46, 48 and 50 have on each side thereof at least one pair of widely spaced, relatively narrow claws embedded at widely spaced points on wide beads 62. This structural concept does not constitute, per se, an aspect of this invention but is described and claimed in U.S. Pat. No. 4,032,811 issued to the assignee of this invention.

As noted, except for the three discrete cathodes 32, 34 and 36, the individual electrodes are "unitized;" that is, they each comprise one mechanical assembly having individual axially aligned apertures for the three coplanar beams 26, 28 and 30. Gun electrodes 42, 46, 48 and 50 are further characterized by having three effectively continuous, electrically shielding beam-passing tubes extending completely through the electrodes, each tube being formed by a contiguous axial succession of deep-drawn annular lips. copending application Ser. No. 834,029.

Figure 1:
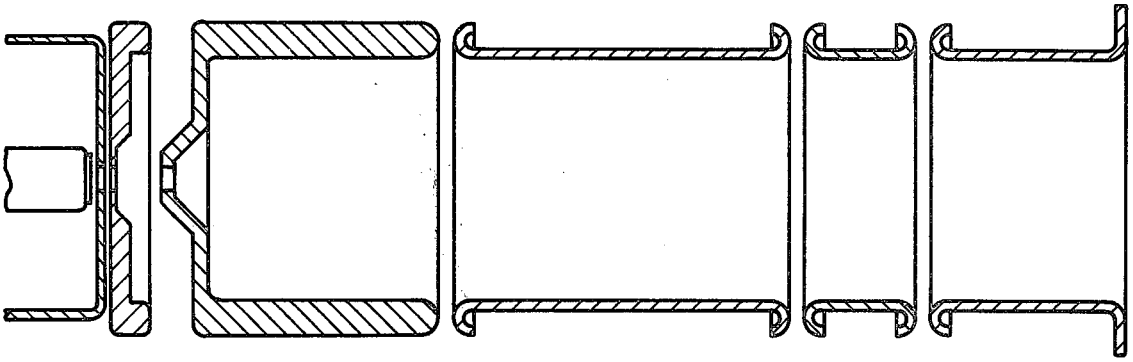
Fig. 1 PRIOR ART
FIG. 1 is an elevational view in section of a prior art electron gun having a tetrode section and an extended field focus lens.
Figure 4:
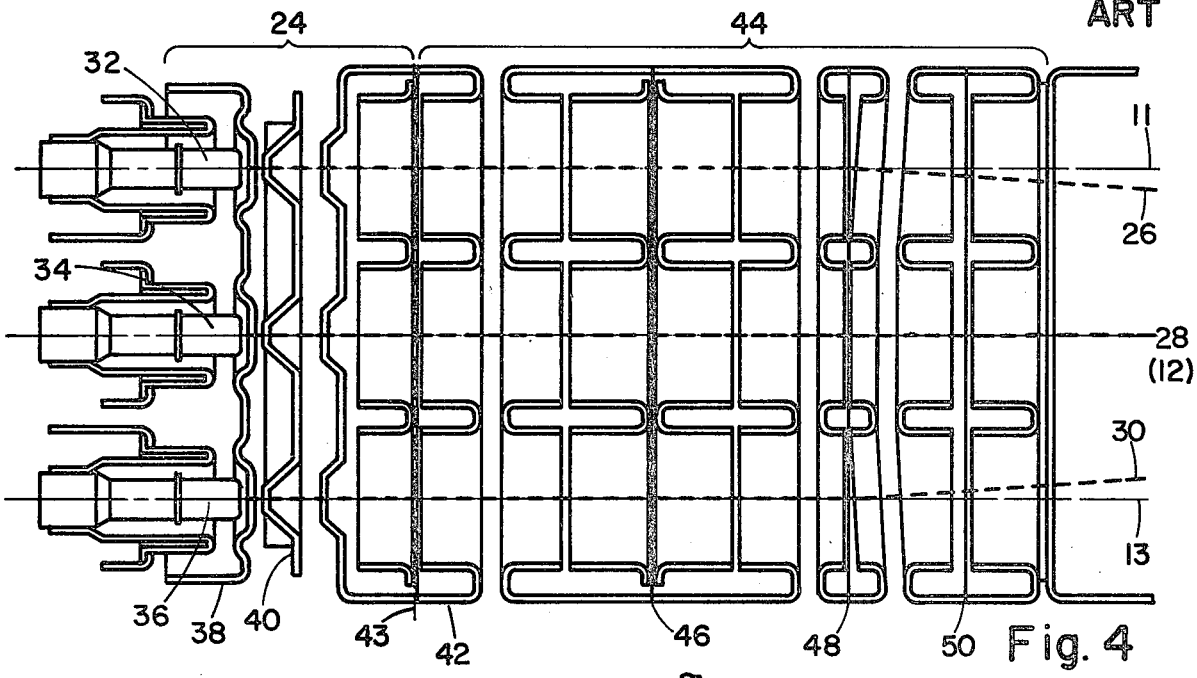
FIG. 4 is a top view in section of the three-beam unitized in-line gun shown by FIG. 3.
Figure 5:
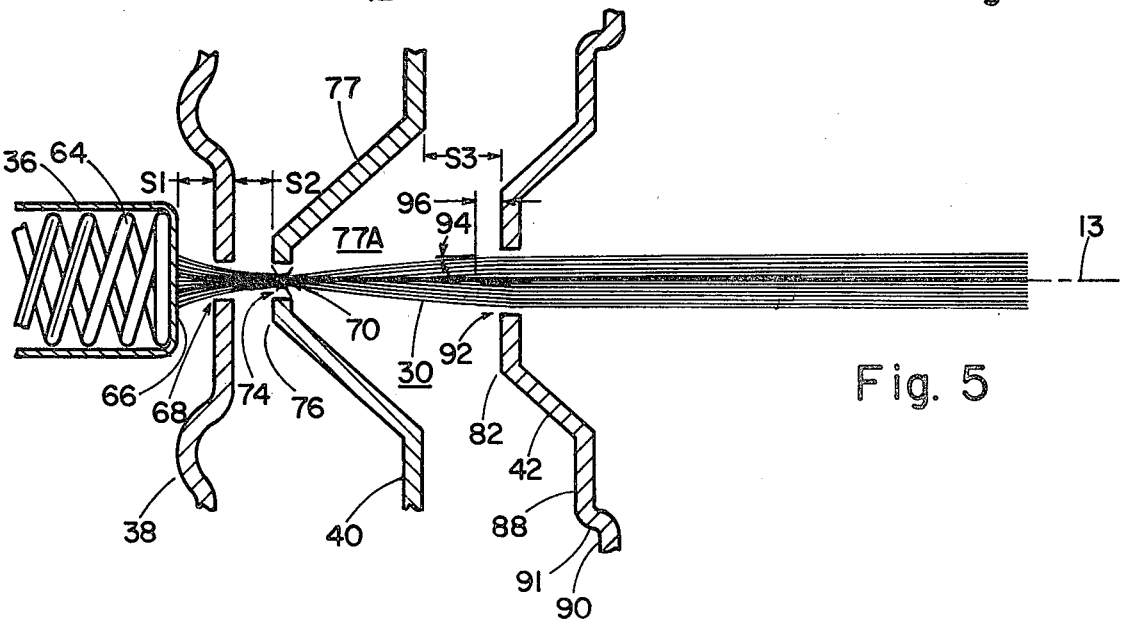
FIG. 5 is a greatly enlarged view in section of a tetrode section of one of the electron guns shown in FIG. 4.

The illustrated preferred embodiment of the tetrode section that is the subject of this disclosure is shown with particular clarity by FIGS. 4 and 5.

The merit of a tetrode section lies in its ability to generate free electrons, and to resolve a cross-over comprising a converged stream of said electrons that is small in diameter, minimal in aberrations, and of uniform cross-section. This cross-over is in turn imaged on the screen of the television cathode ray tube by an electrostatic focus lens.

FIG. 4 is a top view in section of the unitized, in-line gun structure that represents the preferred embodiment of this invention—an embodiment which has been successfully manufactured and tested.

The tetrode section 24 of the unitized, in-line electron gun shown by FIG. 4 is comprised of three discrete cathodes 32, 34 and 36 each supplying electrons through a separate beam passageway for the three beams 26, 28 and 30. A section of third grid 42 is also physically a part of the first focus electrode of main focus lens 44 that follows the tetrode section, as shown by the dashed lines 43 in FIG. 4.

The tetrode part of the electron gun that generates outer beam 30, shown by FIG. 4, is shown in the same top, sectional view in FIG. 5, but greatly enlarged. Operation is as follows: resistive filament 64 enclosed in cathode 36 is energized electrically, causing it to reach a temperature of approximately 1100° K. Cathode 36 is in turn heated through contact with filament 64, causing emission of free electrons from the source of the beam, its electron-emitting surface 66, to generate beam 30.

The potential on cathode 36 is varied, for example, from zero volts to 150 volts positive by the external television video drive circuitry. The potential of unitized first grid 38 is a a constant zero volts. The quantity of electrons, and hence the beam current drawn from cathode 36, is a function of the relative potential of cathode 36 and first grid 38. As cathode 36 is driven more positive, first grid 38 becomes more negative relative to the cathode, with the result that fewer electrons are emitted from cathode 36 to pass through aperture 68 of first grid 38. It is thus that the intensity of beam 30 is controlled by the bias on cathode 36 in relation to first grid 38. As cathode 36 is allowed to become less positive, more electrons are emitted by cathode 36 to pass through aperture 68 of first grid 38.

The free electron emission rate of cathode 36, the spacing S1 (FIG. 5) between cathode 36 and first grid 38, and the diameter of aperture 68 in first grid 38 determines the point at which the beam cross-over 70 is formed. The cross-over is defined as the point at which a stream of principal electrons leaving the cathode form a circle of least confusion on the gun axis following the convergence zone in the first grid aperture. The location of cross-over 70 in the tetrode section that is the subject of this disclosure is normally approximately within the aperture 74 of second grid 40. The cross-over point is not firmly fixed, however, but moves a finite distance toward and away from the cathode 36 as a result of change in cathode potential.

After passing through aperture 68, the electrons that comprise beam 30 are drawn toward second grid 40, which has, e.g., a potential of one kilovolt. The difference in potential between first grid 38 (here zero) and the potential of second grid 40 creates an electrostatic field that provides for strong velocity of the beam to provide a small cross-over 70.

Figure 6:
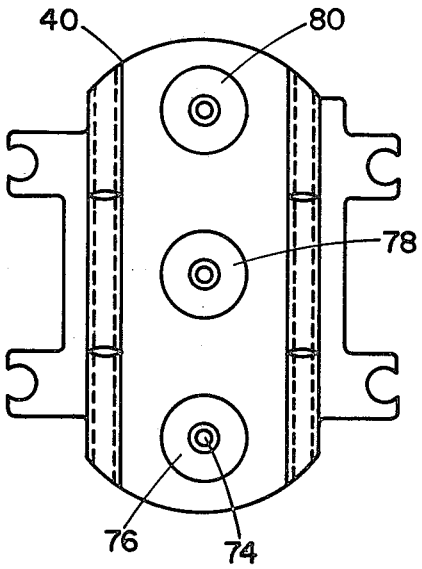
FIGS. 6 and 7 are plan and sectioned side elevation views of a second grid of the tetrode section shown in FIGS. 4 and 5.
Figure 7:
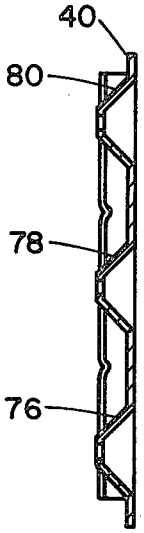

FIG. 6 is a plan view of unitized, disc-type second grid 40; FIG. 7 is a sectional side elevational view of the same grid. A trio of hollow cones 76, 78 and 80 rise steeply from a common plane of second grid 40 and are oriented towards cathodes 32, 34 and 36. The flat on cones 76, 78 and 80 is very limited and has no electron optical effect, but is provided only to reduce the possibility of breaking of the punch used to make the cone apertures.

Referring again to FIG. 5, the space S2 between first grid 38 and second grid 40 is a compromise. Close spacing reduces the possibility of interference from the fields generated by a close-lying electron gun such as the adjacent gun that generates center beam 28. On the other hand, if spacing is too close, the possibility of arcing between first grid 38 and second grid 40 is increased. The diameter of beam passing aperture 68 of first grid 38 is also a compromise in that a smaller aperture will produce a desirably small cross-over; however, too small an aperture will lead to increased current density loading of cathode 36, and hence shorten cathode life. A very small aperture also introduces a problem in manufacture in that the small punch required to make the aperture is more apt to break than a larger punch. In addition, the problem of aperture alignment is exacerbated in that a smaller, less rigid alignment mandrel must be used.

It should be noted that while tetrode designers have sometimes sized apertures to function as "limiters" to dispense with superfluous electrons that may exist in the periphery of the beam, no limiting through aperture restriction is done in the subject tetrode—all electrons are allowed to go through.

Aperture 74 of second grid 40 is identical in diameter to aperture 68 in first grid 38. Both apertures are axially aligned. By making the two apertures identical in diameter, alignment of first grid 38 and second grid 40 by means of mandrels during the manufacturing process is facilitated.

After passing through the point of cross-over 70, beam 30 is caused to have a small, controlled expansion in the strong prefocusing field formed in the interspace between second grid 40 and third grid 42.

Figure 8:
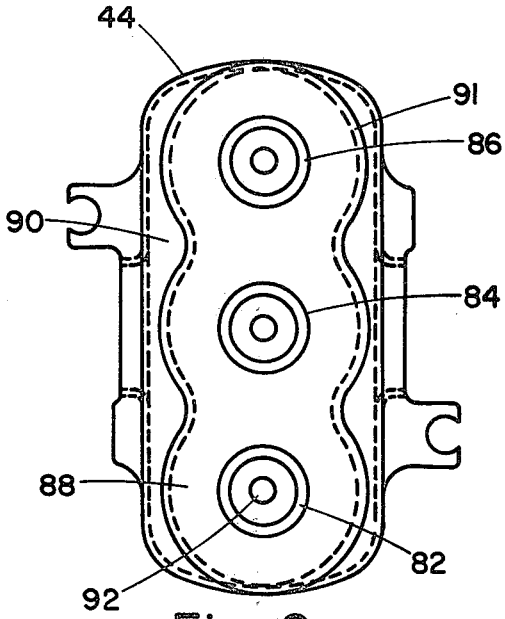
FIGS. 8, 9 and 10 are plan and sectioned side elevation views of a third grid of the tetrode section shown in FIGS. 4 and 5.
Figure 9:
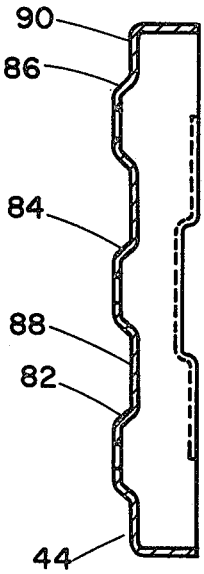
Figure 10:
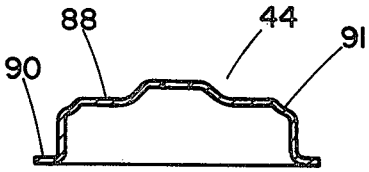

With reference to FIGS. 8, 9 and 10, which show details of third grid 42, the trio of cones 82, 84 and 86 rise steeply from a plateau 88 which in turn is elevated above a base plane 90. Each cone is terminated by a flat having an aperture 92 aligned with one of the apertures 74 in second grid 40. The perimetric curb 91 formed at the material interface of plateau 88 and base plane 90 provides mechanical strength and rigidity for the third grid 42. Also, the use of the plateau 88 together with cones 82, 84 and 86 provides for shielding the beam 30 from distortion that could be induced by the electrostatic charge built up on adjacent surfaces of the near-by glass beads 62. The angles of the trio of cones 76, 78 and 80, and 82, 84 and 86, rise steeply from second grid 40 and third grid 42 are preferably approximately equal, and at a nominal angle of forty-two degrees.

The diameter of aperture 92 of third grid 42 is greater than that of the apertures of the preceding first grid 38 and second grid 40. The determination of the diameter of aperture 92 is a function of the diameter of beam 30 in its path through the aperture; that is, the diameter of aperture 92 and beam 30 as beam 30 passes through aperture 92 are relatively equal. This equality is reflected throughout the gun design in that the beam passageway dimensions and aperture diameters of grids and electrodes conform to those of the beam; that is, they are small where the beam is small, and large where the beam is large.

The different potentials of second grid 40 and third grid 42 are drawn from power supply 18. The potential on second grid 38 is substantially lower than the relatively low potential found in the main focus lens section 44, and the potential on third grid 42 is substantially equal to the relatively intermediate potential found in the main focus lens section. This difference in potential applied across the small length of the prefocus develops a strong electrostatic field which counteracts the tendency toward undesired expansion of the beam due to space charge repulsion. The configuration of second grid 40 provides for a strong convergent refraction of the beam prior to its entry into the main focus lens section. This convergent refraction in the region of the second grid prevents excessive expansion of the beam in the main focus lens which can result in a large filling of the lens and thus a large spherical aberration contribution to spot size.

While providing the benefit of optimum filling, the strong, highly refractive prefocus is also apt to induce spherical aberration sufficient to enlarge the virtual cross-over and hence degrade the resolution. This aberration is suppressed, at least in part, however, in the tetrode section that is the subject of this disclosure. The dimensions, configurations, and relative spacings of second grid 40 and third grid 42, and the potentials applied thereto, are effective to form in the interspace between the two grids in the region of the beam equipotential field lines strongly bent into the hollows of the trio of cones on second grid 40. The lines have a predetermined shape, preferably substantially hyperboloidal to help suppress the strong spherical aberration usually associated with strongly refractive tetrode section designs.

Figure 11:
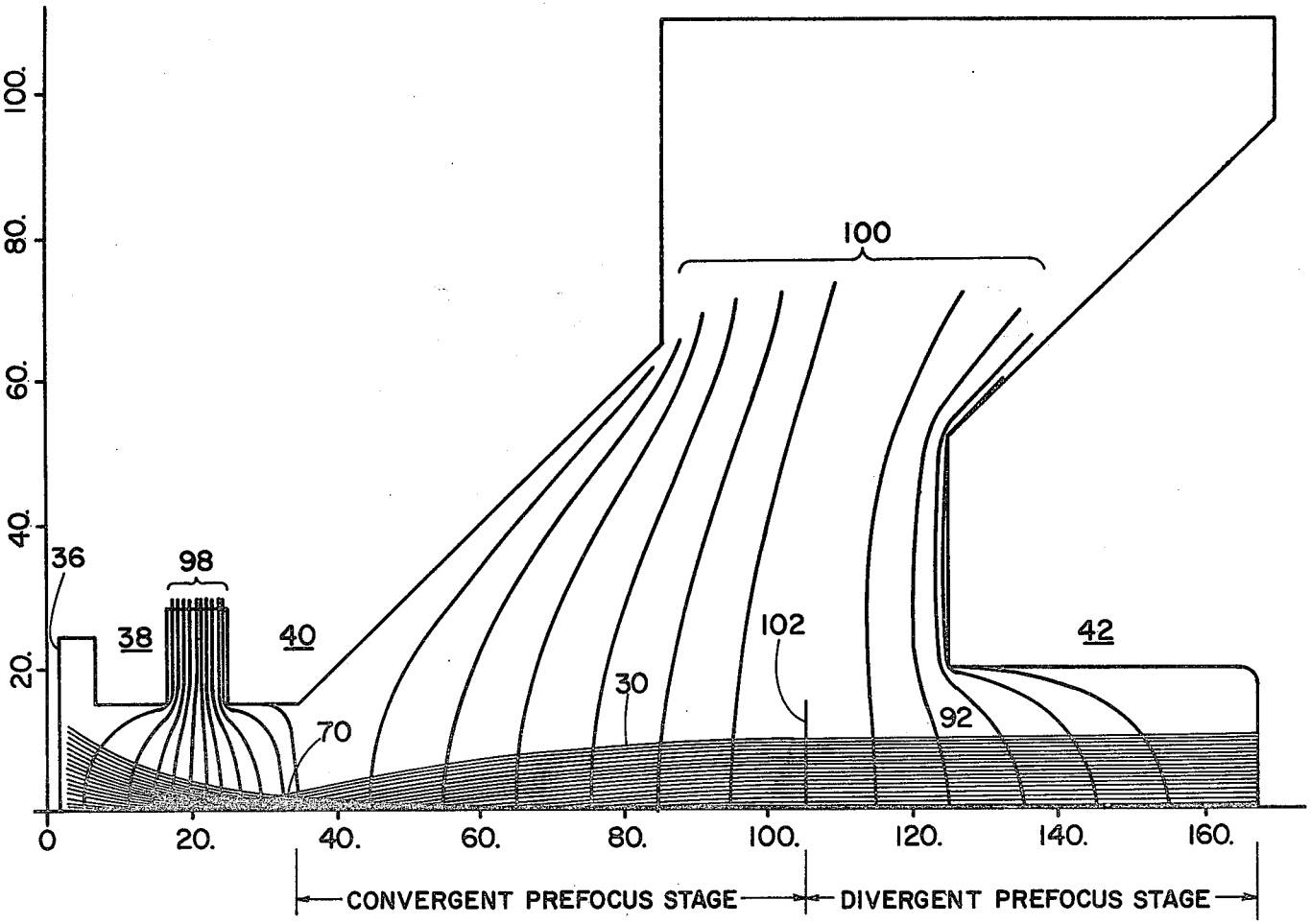
FIG. 11 is a Laplace computer representation of electrostatic fields that exist in the tetrode section that is the subject of this disclosure.

FIG. 11 shows a computer-plotted Laplace representation of the equipotential lines focused in the grid interspace of tetrode 24. The cathode 36 is indicated to show its relationship with adjacent first grid 38. Equipotential lines 98 developed between first grid 38 and second grid 40 indicate the exertion of strong focusing action on the beam to achieve minimum cross-over (70) size. Electrons emerging from the cross-over are then subject to strong prefocusing as shown by the strongly bent equipotential lines 100 generated between second grid 40 and third grid 42. The prefocus field includes, in the region of the beam, equipotential lines which are preferably substantially hyperboloidal to help suppress spherical aberration of the beam. At line 102, beam 30 is no longer strongly refracted but begins to diverge as it passes into aperture 92 of third grid 42 and continues its entry into main focus lens 44.

Figure 12:
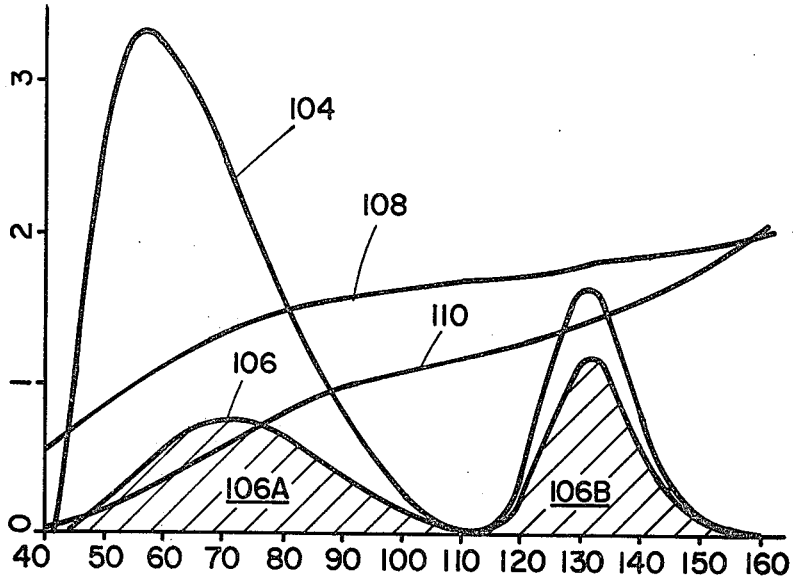
FIG. 12 is a graphical representation of the reduction in spherical aberration achieved by the tetrode section of this invention.

FIG. 12 represents graphically the physical principle used in minimizing spherical aberration in tetrode section 24. The family of curves is identified as follows: intrinsic spherical aberration, 104; actual spherical aberration per unit length, 106; normalized relative beam radius, 108; and normalized beam radius cubed, 110. The units of the abscissa represent the path length down the axis in the area of strong prefocus between second grid 40 and third grid 42. Units of the ordinate are arbitrary. A comparison with FIG. 11 will establish the graphical correlation of the family of curves 104, 106, 108 and 110 of FIG. 12 with the depiction in FIG. 11 of beam 30, second and third grids 40 and 42 and the equipotential lines 100 therebetween.

The curve 104, intrinsic spherical aberration, represents the relative rate at which a theoretical beam of uniform diameter would accumulate spherical aberration in traversing the area of prefocus between second grid 40 and third grid 42. The curve is included because the actual rate at which spherical aberration is added to beam 30 as it traverses the prefocus area is proportional to the intrinsic aberration of the lens and to the cube of the beam radius (curve 110), or diameter, locally. In conventional electron lenses, such as the bipotential-type lens, the intrinsic spherical aberration is large in regions in which the beam radius is near maximum, or maximum. In tetrode section 24, the electron lens formed by the closely spaced trios of cones of second grid 40 and third grid 42 is shaped to increase the effective lens diameter as the beam radius increases so that the intrinsic spherical aberration shown by curve 108, is small where the beam is large. By this means, in tetrode section 24, the actual spherical aberration per unit length (with units as shown on the abscissa) is everywhere small. As a result of this reduction, the total spherical aberration introduced into the beam in the convergent stage of the prefocus area 112, as represented by shaded area 106A under curve 106, is made to be roughly as small as the spherical aberration introduced by the divergent prefocus stage 114 (FIG. 11) of the prefocus lens, as represented by the shaded area 106B under curve 106. As is well known in the art, the divergent stage 114 is relatively low in aberration. The fact that the aberration of the convergent prefocus stage 112 is as minimal as that of the divergent prefocus stage 114 shows that a high quality convergent stage has been achieved.

The width of space S3 between second grid 40 and third grid 42 is a compromise in that too close spacing could result in arcing between second grid 40 and third grid 42.

Further with regard to arcing, the subject tetrode is less prone to arc between adjacent second grid 40 and third grid 42 because the potential of third grid 42 is a relatively intermediate potential. In the preferred embodiment of the tetrode section that is the subject of this disclosure, the potential of third grid 42 may, e.g., be about 12 kilovolts, and second grid 40, e.g., may be about one kilovolt. If, however, the main focus lens were of the unipotential type rather than the extended field type, the potential on the equivalent third grid of the tetrode would then be in the range of 20 to 30 kilovolts, and the tendency toward arcing between adjacent electrodes would be greatly increased.

The relatively intermediate potential of third grid 42 offers another desirable effect as shown by comparison with the equivalent (third grid) potential of the bipotential and the unipotential type lenses. In the commonly used bipotential lens, the potential of the third grid of the tetrode section is relatively low so there is little tendency to arc. However, the low potential also means that there can be little prefocusing of the beam in the intermediate area of the third grid of the bipotential lens. Also, increased space charge contributions due to the low energy of the beam greatly increases the cross-over object diameter.

The high potential of the third grid of the unipotential type lens, on the other hand, (25 to 30 kilovolts), acts to strongly focus the beam and prevent beam "blow up" due to space charge repulsion. This fact accounts for the better performance of the unipotential lens over the bipotential with regard to the diameter of the spot imaged on the screen wherein the unipotential lens produces a much smaller spot and hence provides better resolution. However, as described, the tendency to arc in the unipotential type lens is a very real fact and a serious drawback of unipotential-type focus lenses.

The relatively intermediate potential of third grid 42 of the subject tetrode, which lies between the extremes of 25 to 30 kilovolts of the unipotential lens, and the low potentials of the bipotential lens, combines the better features of both lens types in that the size of the cross-over is held to a minimum by the strong electrode field, while at the same time, the possibility of arcing is greatly reduced.

Referring again to FIG. 5, half-angle 94 is measured in the space between second grid 40 and third grid 42. A half-angle is defined as the angle, or slope, of the outer envelope of the beam as it increases in diameter in relation to the axis of the gun. Half-angle 94 is measured from a "cut line" 96 spaced an arbitrary distance S4 (20 mils) from the flat of cone 82 of third grid 42. The half-angle 94 is given to good approximation by the expression:

$$\theta_{\frac{1}{2}} = 0.022 I(\mu A)^{\frac{1}{2}} / V_{kV}^{\frac{1}{2}} \text{ radians}$$

for a neutral accelerating prefocus, where I($\mu$A) is beam current (in micro-amperes), and $V_{kV}$ is beam voltage (in kilovolts). A beam's half-angle is essentially a measure of its growth in diameter as it it diverges from the cross-over 70. A relatively small half-angle is considered desirable in that it connotes low beam growth and initiates proper filling of the following main focus lens 44 by the beam 30. Also, the very small beam half-angle 94 provided by the subject tetrode section, which may be 40 milliradians or less, provides great depth of focus; that is, the rate of spot growth in response to change in the focus voltage is very low. This great depth of focus is a valuable attribute in gun manufacture in that differences in physical characteristics of guns resulting from manufacturing errors have a less significant effect on spot size. In comparison, prior art tetrodes in common use provide little or no beam prefocusing, and may have half-angles in the range of 90 to 120 milliradians. Guns with such tetrodes are notable for large spot sizes, whereas the tetrode and main focus lens assembly that makes up the electron gun which is the subject of this invention provide spot sizes which are much smaller than those produced by most conventional prior art electron guns. Also, as noted, a shallow depth of focus aggravates manufacturing problems in that tolerances become more critical, especially in a unitized structure with common focus electrodes.

It is noteworthy that the tetrode section design of this invention provides a very low penetration factor, with penetration factor being defined as the intrusion of the high-voltage field of the main focusing lens into the beam-forming and cross-over-shaping fields of the triode section. Such penetration is undesirable in that the beam modulation characteristic becomes a function of the voltage on the third grid 42, instead of being regulated by the voltage on the second grid 40. As a result, any sag in third grid voltage due to loading of the anode power supply by the beam current may result in a change in black level of the picture with time, resulting in poor picture quality. Because of the special configuration of second grid 40 as described by this invention, the low penetration factor to the cathode of the tetrode provides a constant black level independent of fluctuations in third grid voltage during operation.

After passing through aperture 92 of third grid 42, the electrons constituting beam 30 enter the influence of main focus lens 44. Main focus lens 44 is comprised of first, second, third and fourth focus electrodes 42, 46, 48 and 50. As noted, third grid 42 and first electrode 42 are physically common; that is, the "lower" end, or section facing the cathode, functions as the third grid of the tetrode 24, while the "upper" section, which faces the screen of the color cathode ray tube is part of main focus lens 44.

The role of the tetrode section is to provide to the main focus lens a cross-over 70 which is small, and free as possible from spherical aberration, and uniform in cross-section. The role of the main focus lens 44, in turn, is to focus a real image of the cross-over 70 on the screen of the cathode ray tube without introducing spherical or other aberration, and with minimal magnification of the cross-over. While focusing the real image of the cross-over 70 on the screen, the main focus lens 44 must increase the energy of the beam 30 to a point at which maximum phosphor brightness is achieved. Conventional focus lenses have been guilty of introducing a substantial measure of spherical aberration while increasing beam energy.

The extended field focus lens concept that provides the benefits of small spot size and enhanced picture brightness takes advantage of certain principles described and claimed in U.S. Pat. No. 3,895,253 assigned to the assignee of this invention. A second invention in extended field lenses is described and claimed in U.S. Pat. No. 3,995,194 also assigned to the assignee of this invention. The lens described and claimed in the U.S. Pat. No. 3,995,194 is preferably used with tetrode section of this invention, resulting in a gun that meets the objectives of high picture brightness (implying relatively high beam currents) and high resolution (implying relative small focused beam spot size).

Referring again to FIGS. 2 and 3, the four elements of main focus lens 44 are the first, second, third and fourth focus electrodes 42, 46, 48 and 50. The main focus lens is characterized by its having a single, continuous axial potential distribution in the direction of electron beam flow which at all times during tube operation, decreases smoothly and monotonically from a relatively intermediate potential taken from said power supply, to a relatively low potential; that is, a potential which is many kilovolts lower than said relatively intermediate potential, spatially located at a lens intermediate position, and then increases smoothly, directly and monotonically from the relatively low potential to a relatively high potential; that is, a potential which is many kilovolts higher than the relatively intermediate potential.

The exemplary specifications of the tetrode structure shown by FIGS. 2–12, which has been produced and successfully tested, are as follows: the sheet metal material from which the unitized electrodes are die-stamped can be, for example, an austenitic stainless steel, AISI type 305, having a nominal thickness of 0.010 inch. The exemplary dimensions of the electrodes that comprise the tetrode section are set forth as follows. (Note: in these dimensions, "depth" means the dimension in an axial direction). The diameter of the emitting faces of cathodes 24, 25 and 27 is 0.082 inch. The nominal dimensions of first grid 26 are 0.644 inch in height by 0.794 inch in width by 0.150 inch in depth; second grid electrode 28, 0.644 inch in height by 0.785 inch in width by 0.070 inch in depth; and, third grid 32, 0.644 inch in height by 0.870 inch in width by 0.263 inch in depth.

Referring to FIG. 5, the nominal spacing S1 between cathode 36 and first grid 38 is 0.004 inch. Spacing S2 between first grid 38 and second grid 40 is 0.008 inch. Spacing S3 between second grid 40 and third grid 42 is 0.040 inch. With regard to exemplary diameters of the grid apertures, the diameters 68 and 74 of first grid 38 and second grid 40 are identical; that is, 0.029 inch, while the aperture 92 of third grid 42 is 0.065 inch.

To avoid positional distortion and aberration it is important that the beam-passing apertures of the tetrode section be in axial alignment. For example, in the illustrated preferred embodiment, the apertures 68, 74 and 92 of first, second and third grids 38, 40 and 42 are axially aligned within a tolerance of 0.0005 inch.

The distance between the equidistant axes 11, 12 and 13 of gun 10 (referring to FIG. 2) is 0.27 inch. The diameters of the beam-passing apertures of main focus electrode 32 (upper end), 34, 36 and 38 are 0.226 inch +0.0005, −0.0000 inch. These tight aperture tolerances are necessary to facilitate and ensure proper axial alignment in the process of manufacture. Any significant misalignment can result in pronounced aberrations of a beam manifested primarily as astigmatic distortion on the cathode ray tube screen. By the same token, the apertures of the main focus electrodes 32, 34, 36 and 38 are held in coaxial alignment to within 0.0015 inch.

It is noted that the specifications cited in the foregoing are not in any sense limiting, but are provided for exemplary reasons to depict one operating configuration of applicant's invention.

Figure 13:
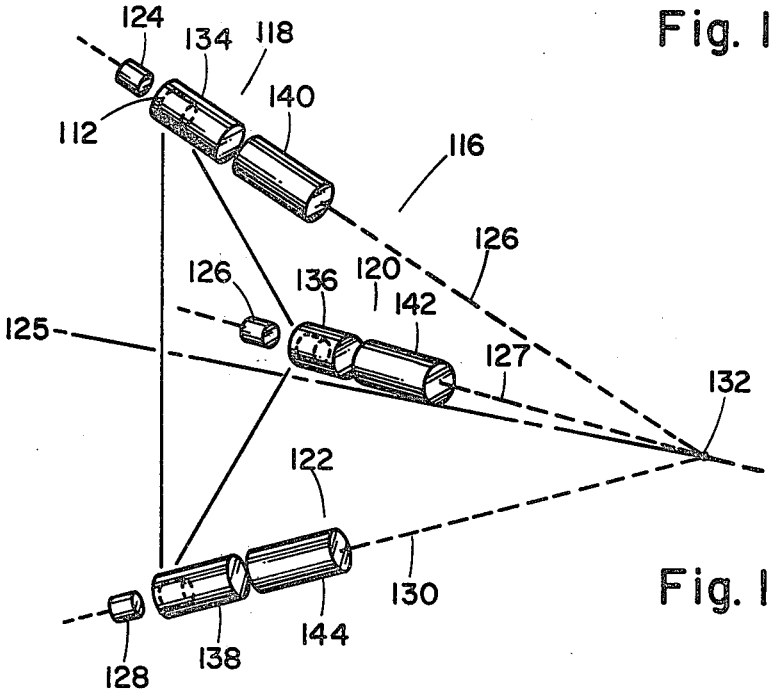
FIG. 13 is a simplified schematic view in perspective of a tetrode section according to this invention as applied to a delta-cluster electron gun.

FIG. 13 shows a simplified schematic view in perspective of another embodiment of this invention. Electron gun 116 has three identical gun means 118, 120 and 122 arranged in a delta-cluster, or triangular configuration. Except for three discrete and identical cathodes 124, 126 and 128, all gun anodes are unitized; that is, each anode has a common structure. In the configuration shown, each of the three guns 118, 120 and 122 are tilted inwardly, and slightly out of parallelism with the gun center axis 125, causing the three beams 126, 127 and 130 to converge at a common point of landing 132 on the screen of a television cathode ray tube (not shown). Similar unitized tetrode sections 134, 136 and 138 constructed according to this invention provide three beam cross-overs to similar unitized four-element main focus extended field lenses 140, 142 and 144. Except for the difference in basic configuration; that is, delta-cluster versus in-line, the function and operation of the tetrode sections 134, 136 and 138 of delta-cluster gun 116, and tetrode section 24 of in-line gun 10 (with reference to FIG. 3) are the same as described in the foregoing for the in-line gun 10. Also, the function and operation of the unitized main focus extended field lenses 140, 142 and 144 of delta-cluster gun 116, and the unitized main focus extended field lens 44 of in-line gun 10 are the same as described for the in-line gun.

Figure 14:
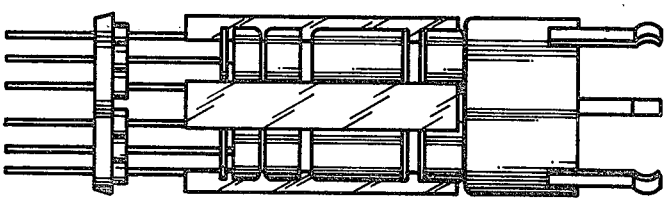
FIG. 14 is a side view showing an assembled side view of the delta-cluster electron gun shown schematically in FIG. 13.

A schematic realization of the FIG. 13 delta gun is shown by FIG. 14. In addition to the preferred embodiment described and shown in this disclosure, the invention is equally applicable to other than three-beam unitized guns; that is, it is applicable to electron guns such as the single-beam gun used in monochrome television cathode ray tubes; and in electron guns used in beam index tubes—in short, for all cathode ray tube displays that require at least one beam that provides a small, symmetrical spot having a uniform cross-section.

Other changes may be made in the above-described apparatus without departing from the true spirit and scope of the invention herein involved, and it is intended that the subject matter in the above depiction shall be interpreted as illustrative and not in a limiting sense.

We claim:

1. For use in a color television cathode ray tube of the small-neck, shadow-mask type having associated therewith a power supply for developing gun supply voltages, a three-beam, unitized electron gun; that is, a gun having three-apertured electrode means common to the three beams, with each aperture aligned with a separate beam axis, said gun receiving said supply voltages to produce in the tube neck an in-line coplanar cluster, or delta-cluster, of red-associated, green-associated and blue-associated electron beams, with said gun having a tetrode section which generates said three beams and three beam cross-overs, said tetrode section being followed by and being in combination with, a main focus lens section comprising at least three electrode means for focusing said cross-overs on a viewing screen of said tube, said main focus lens section being characterized by its having a single, continuous axial potential distribution which in the direction of electron beam flow and at all times during tube operation, decreases smoothly and monotonically from a relative intermediate potential to a relatively low potential; that is, a potential which is many kilovolts lower than said relatively intermediate potential, spatially located at a lens intermediate position, and then increases smoothly, directly and monotonically from said relatively low potential to a relatively high potential; that is, a potential which is many kilovolts higher than said relatively intermediate potential, and wherein said combination is distinguished by having an improved tetrode section characterized by strong electrostatic prefocusing; that is, a strong prefocusing of a beam prior to its entry into said main focus lens section effective to produce a relatively small beam half-angle with a resulting great depth of focus, said tetrode section comprising in combination:

three discrete cathode means for generating sources of three electron beams;

unitized first grid means having three apertures aligned with said three cathode means for forming in conjunction with said cathode means, three beam cross-overs;

unitized second grid means having a potential taken from said power supply which is substantially lower than said relatively low potential found in said main focus lens section, and having a trio of hollow cones extending toward said first grid means, the cones of said trio rising steeply from a common plane with each being terminated by a flat having a beam-passing aperture aligned with one of said three apertures in said first grid means, said flats being small in radius so the sides of said cones closely crowd said beams, said second grid means forming in conjunction with said first grid means, three regions of divergent electrostatic lens action focusing the beams in the vicinity of said three beam cross-overs, the material of said second grid means being relatively thick; that is, having a thickness of ten mils, with said cross-overs lying approximately within the aperture of the second grid means;

unitized third grid means having a potential taken from said power supply which is substantially equal to said relatively intermediate potential and therefore very much higher than said potential on said second grid means, said third grid means having a trio of hollow cones extending toward said second grid means and closely spaced thereto, the cones of said trio rising steeply from a plateau which is in turn elevated above a base plane, said plateau together with said cones providing for shielding said beams from distortion induced by nearby electrostatic charge build-up, with each of said cones being terminated by a flat having a beam-passing aperture aligned with one of said three apertures in said second grid means, wherein said second grid means and said third grid means cooperate to produce strongly refractive convergent fields and said relatively small half-angles of 40 milliradians or less for each of said beams, resulting in said great depth of focus, and with the separation of the cathode-side faces of said second and third grid means being of the order of 100 mils, and wherein the dimensions, configurations, relative spacings of said second grid means and said third grid means and the potentials applied thereto being effective to form in the interspace between said second grid means and said third grid means in the region of the beam equipotential field lines strongly bent into the hollows of said cones on said second grid means, said lines having a predetermined substantially hyperboloidal shape helping to suppress the strong spherical aberration usually associated with strongly refractive convergent fields, said field lines further providing beam trajectories substantially parallel to the axes of said beams, whereby said combination produces symmetrical beam spots of small diameter having a small rate of spot growth in response to changes in focus voltage.

2. The tetrode section defined by claim 1 wherein the potential applied to said second grid means is about one kilovolt, and wherein the potential applied to said third grid means is about twelve kilovolts.

3. The tetrode section defined by claim 1 wherein the angles of said trios of cones rising steeply from said second grid means and said third grid means are approximately equal.

4. The tetrode section defined by claim 1 wherein a perimetric curb formed at the material interface of said plateau and said base plane provides mechanical strength and rigidity to said third grid means.

* * * * *